US006520807B2

(12) United States Patent
Winings

(10) Patent No.: US 6,520,807 B2
(45) **Date of Patent: *Feb. 18, 2003**

(54) ELECTRICAL CONNECTOR SYSTEM WITH LOW CROSS-TALK

(75) Inventor: Clifford L. Winings, Etters, PA (US)

(73) Assignee: FCI Americas Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/439,657

(22) Filed: Nov. 12, 1999

(65) Prior Publication Data

US 2001/0055913 A1 Dec. 27, 2001

(51) Int. Cl.[7] ..... H01R 24/00

(52) U.S. Cl. ..... 439/676; 439/941; 439/417; 439/894

(58) Field of Search ..... 439/676, 417, 439/894, 404, 941

(56) References Cited

U.S. PATENT DOCUMENTS

| | | | | |
|---|---|---|---|---|
| 4,978,316 A | | 12/1990 | Yahata | |
| 5,562,479 A | | 10/1996 | Pallas et al. | |
| 5,571,035 A | | 11/1996 | Ferrill | |
| 5,624,274 A | | 4/1997 | Lin | |
| 5,655,284 A | | 8/1997 | Ferrill et al. | |
| 5,888,100 A | | 3/1999 | Bofill et al. | |
| 5,899,770 A | * | 5/1999 | Ezawa | 439/418 |
| 5,921,818 A | | 7/1999 | Larson et al. | |
| 6,099,345 A | | 8/2000 | Milner et al. | |

FOREIGN PATENT DOCUMENTS

| | | |
|---|---|---|
| EP | 0 854 664 A1 | 7/1998 |
| GB | 2 314 466 A | 6/1997 |
| GB | 2344706 A | 6/2000 |
| JP | 9-35788 | 2/1997 |

* cited by examiner

*Primary Examiner*—P. Austin Bradley
*Assistant Examiner*—Truc Nguyen
(74) *Attorney, Agent, or Firm*—Woodcock Washburn LLP

(57) ABSTRACT

An electrical connector system, comprising: an electrical connector; a plurality of wires extending from the connector and arranged in a plurality of twisted pairs; and an insert separating the wires defining each of the twisted pairs. A method of reducing cross-talk in an electrical connector system that produces an unwanted cross-talk, comprising the steps of: providing an electrical connector with a plurality of wires extending therefrom and arranged in a plurality of twisted pairs; providing an insert; placing the insert between the wires defining each of the twisted pairs. The insert causes the wires to produce a compensating cross-talk that offsets the unwanted cross-talk. A method of using an electrical connector that exhibits an acceptable level of cross-talk within a desired frequency range, comprising the steps of: providing an electrical connector system that is unable to exhibit the acceptable level of cross-talk within the desired frequency range, the system including: an electrical connector; and a plurality of wires extending from the connector and arranged in a plurality of twisted pairs; separating the wires defining each of the twisted pairs; and operating the connector system within the desired frequency range. As a result, the connector system exhibits the desired level of cross-talk.

5 Claims, 11 Drawing Sheets

ELECTRICAL CONNECTOR SYSTEM WITH LOW CROSS-TALK

BACKGROUND OF THE INVENTION

1. Field of the Invention

The present invention relates to electrical connector systems. More specifically, the present invention relates to electrical connector systems that exhibit low cross-talk.

2. Brief Description of Earlier Developments

Consumer demand for higher speed electronic devices affects all of the components used in an electronic device. As an example, the electrical connectors used in these electronic devices must be designed so as to ensure that the connectors will operate at these increased speeds without, for example, affecting signal integrity or interfering with any nearby components. In addition to the demand for increased operating speed, the design of the electronic device typically requires that the electrical connector occupy the same, if not less, area within the device.

One concern with operating electrical connectors at high speeds (e.g. approximately 100 MHz and above) is controlling cross-talk. Cross-talk occurs when electromagnetic energy transmitted through a conductor in the connector causes electrical currents in the another conductor in the electrical connector. Near-end cross-talk (NEXT) travels in a direction opposite to the signal in the conductor. As an example, ANSI/EIA/TIA/568A Category 5 requirements limit pair-to-pair NEXT to −40 dB at 100 MHz. Some applications require such cross-talk performance, but measured on a power sum basis.

Various techniques currently exist to improve cross-talk performance in an electrical connector system. Some techniques reduce the amount of cross-talk created by the system (hereinafter called unwanted cross-talk). For instance, U.S. Pat. No. 5,571,035 describes an insert placed within a modular jack plug housing. The insert locates the conductors of each pair close to each other, while separating the pair from other pairs to reduce the amount of cross-talk generated by the system. At the location of the insert, the conductor wires are no longer arranged as twisted pairs.

Other techniques deliberately introduce a cross-talk to the system (hereinafter compensating cross-talk) that reduces, or offsets, any unwanted cross-talk generated by the system. As an example, U.S. Pat. No. 5,562,479 describes an insert placed within a cable connector housing. The insert aligns the wires in a side-by-side orientation to create the compensating cross-talk.

U.S. Pat. No. 5,921,818 describes a modular jack receptacle using insulation displacement contacts on lead frames. Selected conductors crossover each other within the receptacle housing.

British Patent Application GB 2 314 466 describes a compensation pattern on a multi-layer board (MLB) to which contacts from an electrical connector secure. Capacitive coupling between adjacent unlike paths produces a compensating cross-talk to reduce the unwanted cross-talk produced by the connector. The pattern also staggers adjacent paths on a layer in order to allow coupling between non-adjacent paths.

European Patent Application number EP 0 854 664 also describes a compensation pattern on an MLB to which the electrical connector contacts connect. The arrangement of the paths ensures that one path of a pair overlies at least two paths, each from a different pair.

While these techniques can help reduce, or even prevent, cross-talk, further increases in the operating speeds of electronic devices continually demand additional measures for cross-talk prevention or cross-talk prevention.

SUMMARY OF THE INVENTION

It is an object of the present invention to provide an electrical connector system with features for cross-talk compensation.

It is a further object of the present invention to provide a low cross-talk electrical connector system.

It is a further object of the present invention to provide an apparatus for reducing cross-talk capable of being used with current electrical connectors.

It is a further object of the present invention to provide an apparatus for reducing cross-talk that does not require extensive redesign of current electrical connector systems.

These and other objects of the present invention are achieved in one aspect of the present invention by an electrical connector system, comprising: an electrical connector; a plurality of wires extending from the connector and arranged in a twisted pair; and an insert separating the wires defining each of the twisted pairs.

These and other objects of the present invention are achieved in another aspect of the present invention by a method of reducing crosstalk in an electrical connector system that produces an unwanted crosstalk, comprising the steps of: providing an electrical connector with a plurality of wires extending therefrom and arranged in a plurality of twisted pairs; providing an insert; placing the insert between the wires defining each of said twisted pairs. The insert causes the wires to produce a compensating cross-talk that offsets the unwanted cross-talk.

These and other objects of the present invention are achieved in another aspect of the present invention by an electrical connector system having an electrical connector with at least two twisted pairs of wires extending therefrom, wherein the improvement comprises an insert placed between the wires defining each of the twisted pairs.

These and other objects of the present invention are achieved in another aspect of the present invention by a method of using an electrical connector that exhibits an acceptable level of cross-talk within a desired frequency range, comprising the steps of: providing an electrical connector system that is unable to exhibit the acceptable level of cross-talk within the desired frequency range, the system including: an electrical connector; and a plurality of wires extending from the connector and arranged in a plurality of twisted pairs; separating the wires defining each of the twisted pairs; and operating the connector system within the desired frequency range. As a result, the connector system exhibits the desired level of cross-talk.

BRIEF DESCRIPTION OF THE DRAWINGS

Other uses and advantages of the present invention will become apparent to those skilled in the art upon reference to the specification and the drawings, in which.

DETAILED DESCRIPTION OF THE PREFERRED EMBODIMENTS

The present invention relates to an apparatus for reducing cross-talk in an electrical connector system. Generally speaking, the apparatus provides cross-talk reduction in signal lines at a location preferably outside of the electrical connector housing. As will be described in more detail below, the apparatus introduces a compensating cross-talk that preferably offsets most of the unwanted cross-talk created in other areas of the connector system. Importantly, the present invention could be part of a connector system that provides compensating cross-talk at other areas, such as within a connector or within a substrate (such as a multilayer board).

Figure 1:
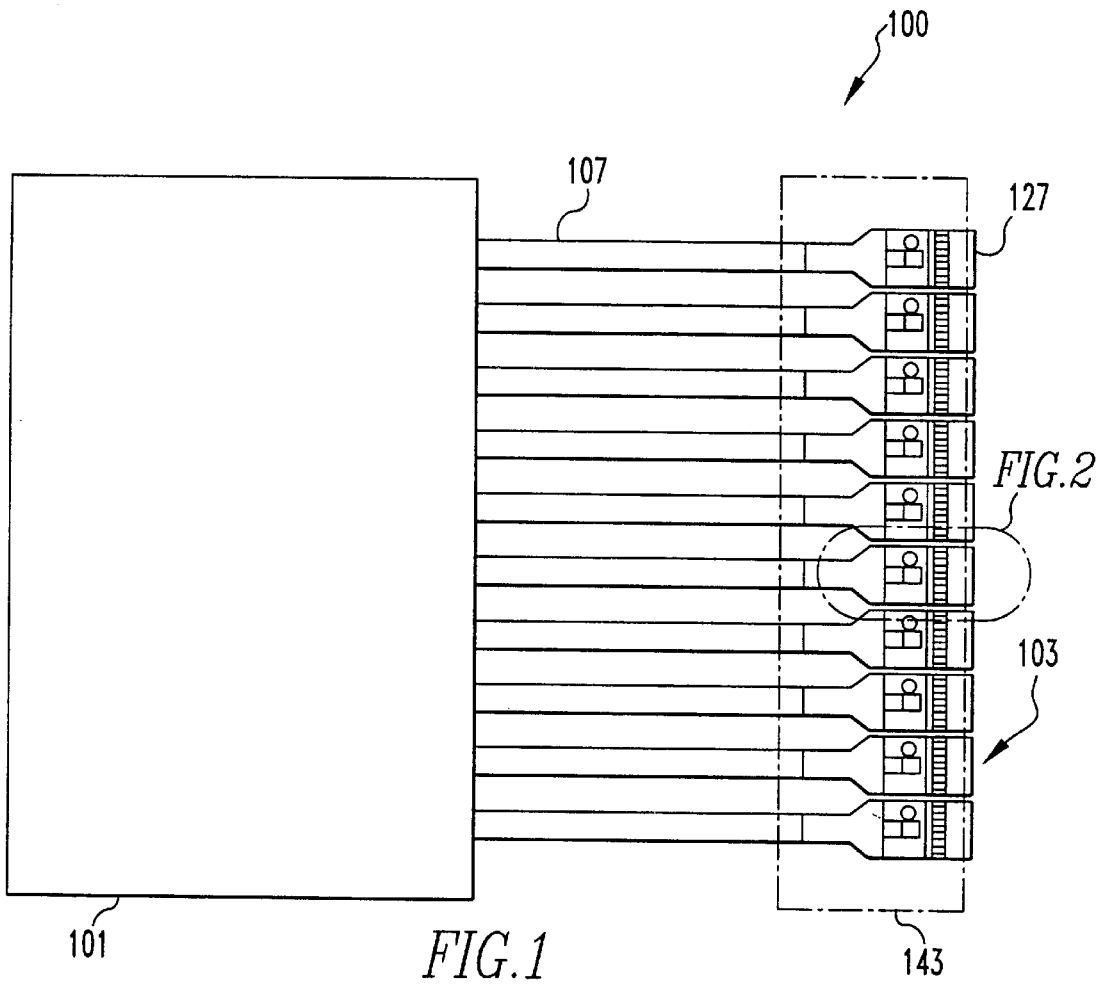
FIG. 1 is a top view of an electrical cable assembly, in partial schematic, utilizing the present invention.
Figure 2:
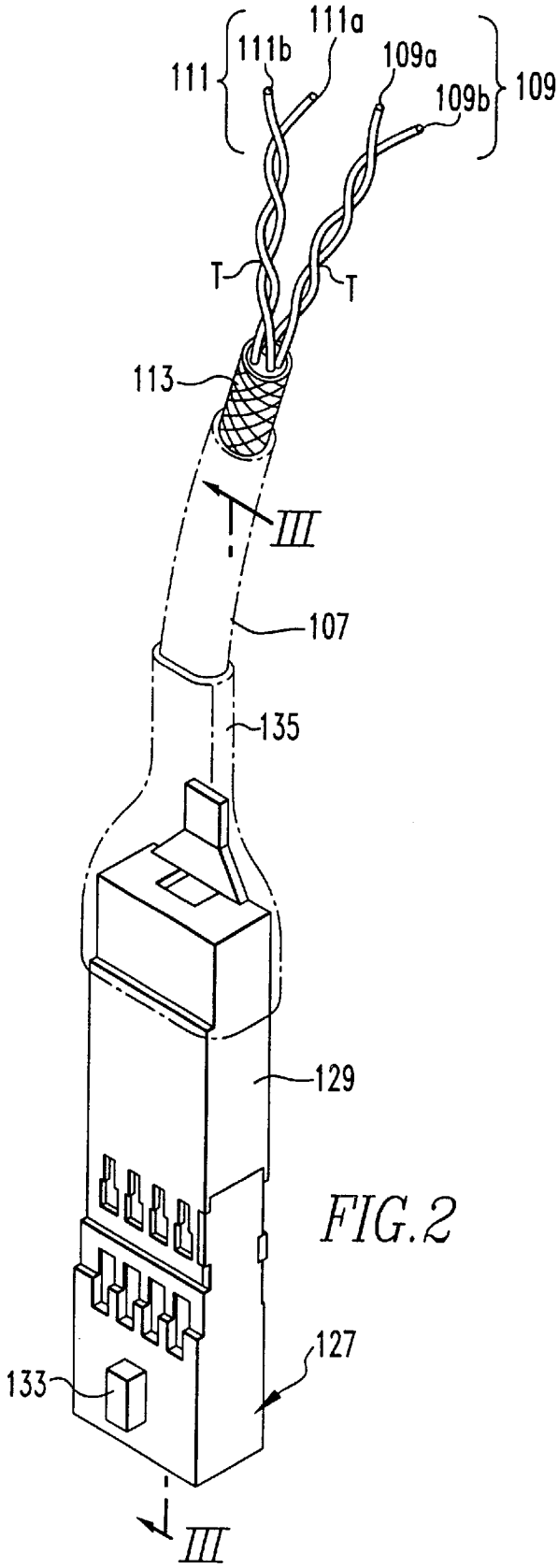
FIG. 2 is a detailed perspective view, in partial phantom, of one electrical connector of the cable assembly shown in FIG. 1*b;*

Recognizing that the present invention could operate in any suitable electrical connector system, FIG. 1 provides one example of such an electrical connector system, in partial schematic. The electrical connector system could be a cable assembly 100 with a first end 101 (shown in schematic) and an opposite second end 103. Cables 107 extend between first end 101 and second end 103.

Since a detailed discussion of first end 101 is unnecessary for an understanding of the present invention, only a brief description follows. First end 101 could utilize conventional components, including one or more receptacle connectors (not shown). The receptacle connectors could mount to, for example, a bulkhead (not shown) of an electronic device (not shown) such as a multiplexer, router, switch or network server. As an example, the receptacle connector could be a Category-5, 25-pair PCB-mounted Telco connector such as part number 92509 available from FCI Electronics of Valley Green, Pa.

The receptacle connector at first end 101 can through hole mount on a printed circuit board (PCB) using known techniques. Cables 107 preferably secure to pads/vias (not shown) on the opposite end of the PCB (not shown), also using known techniques. Cable 107 could be secured to the PCB with, for example, tie-wrap (not shown) to provide strain relief.

Various traces (not shown) on or within the PCB connect the pads/vias with the through holes to which the receptacle connector mounts. Signal conditioning components, such as common mode chokes could engage the traces in any known manner to help control EMI by filtering out common mode noise.

A cover (not shown) can secure to the PCB using known fasteners (not shown). The cover would protect the connector, PCB, signal conditioning components, the solder joints between the pads and wires 109*a,* 109*b,* 111*a,* 111*b* and the solder joint between the pads and the conductive sheath of cable 107. The cover could also receive tie-wrap (not shown) to provide an additional level of strain relief to cables 107.

The second end 103 of cable assembly 100 will now be described in detail. Second end 103 includes one or more connectors 127 that plug on to, for example, headers (not shown) on a backplane (not shown). As an example, connector 127 could be a 2×4 box connector, such as part number A0329312 also available from FCI Electronics.

Figure 5:
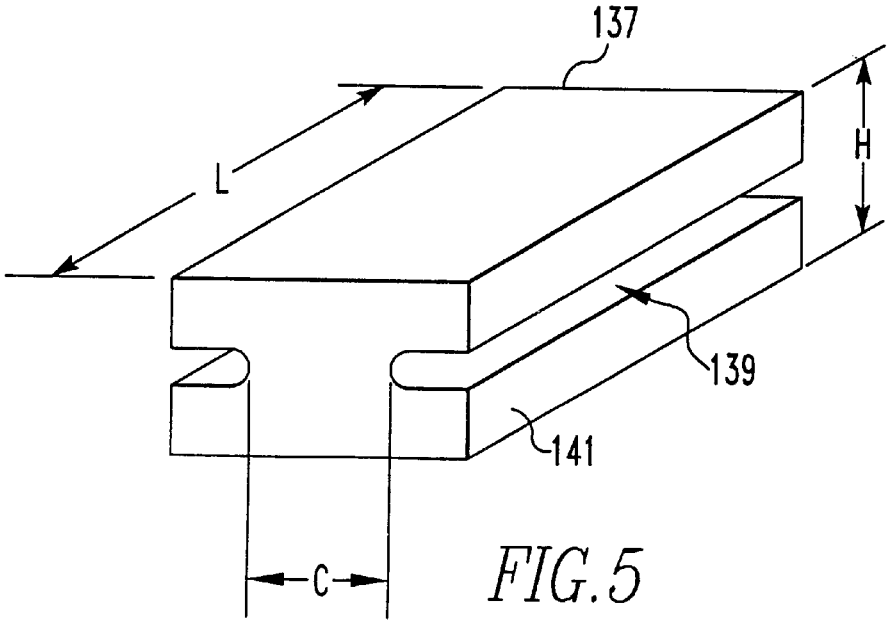
FIG. 5 is a perspective view of one alternative embodiment of the insert of the present invention.

Wires 109*a,* 109*b,* 111*a,* 111*b* terminate at respective contacts (not shown) within connector 127 using known techniques. While FIG. 5 shows connector 127 having unused positions (i.e. connector 127 has eight positions, but only receives four wires), the connector could have any suitable arrangement or could use an entirely different connector.

Figure 4:
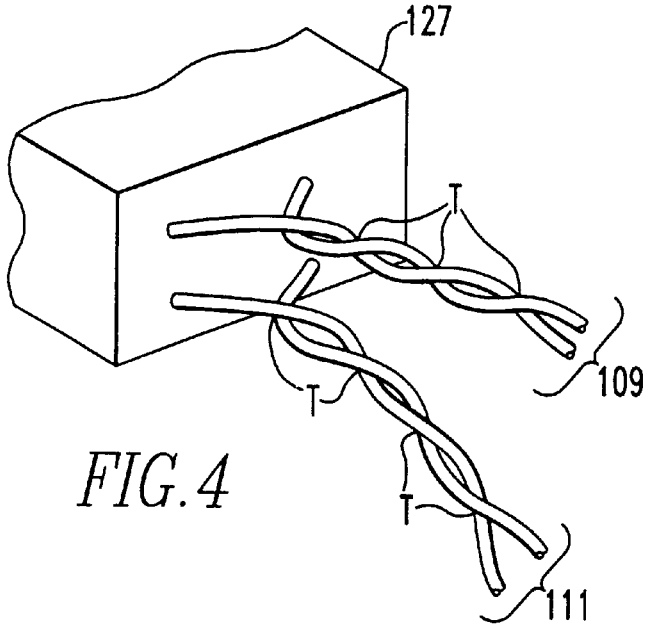
FIG. 4 is a rear, perspective view of part of the electrical connector shown in FIG. 2 before installation of the present invention.

As shown in FIG. 4, wires 109*a,* 109*b,* 111*a,* 111*b* can form twisted pairs 109, 111 upon exiting connector 127. Each of the pairs 109, 111 has a series of twists T.

A cover 129 can partially surround connector 127, preferably the rear end of connector 127. Cover 129 helps protect the portion of wires 109*a,* 109*b,* 111*a,* 111*b* located therein. The remainder of cable 107 extends from cover 129.

A strain relief element 135 surrounds cover 129 and a portion of cable 107 extending from cover 129. Strain relief element 135 helps prevent damage to the contacts or to the connection between the contacts and wires 109*a,* 109*b,* 111*a,* 111*b*. Strain relief element 135 could be heat shrinkable tubing, or any other suitable structure.

Connector 127 can include a polarization tab 133. Tab 133 can ensure proper orientation during mating by interacting with corresponding structure (not shown) on the mating connector.

If desired, and as shown in phantom in FIG. 1, a larger housing 143 could be used to arrange a plurality of connectors 127 and covers 129 together. Housing 143 could be any conventional housing. Alternatively, cover 129 could be enlarged to accept more than one connector 127.

As shown in FIG. 5, the present invention comprises an insert 137. Preferably made from a block of a suitable dielectric material such as a thermoplastic. Insert 137 includes grooves 139 along opposed surfaces such as sidewalls 141. Grooves 139 receive selected wires 109*a,* 109*b,* 111*a,* 111*b* after exiting connector 127. Grooves 139 are located a distance C apart.

Figure 6:
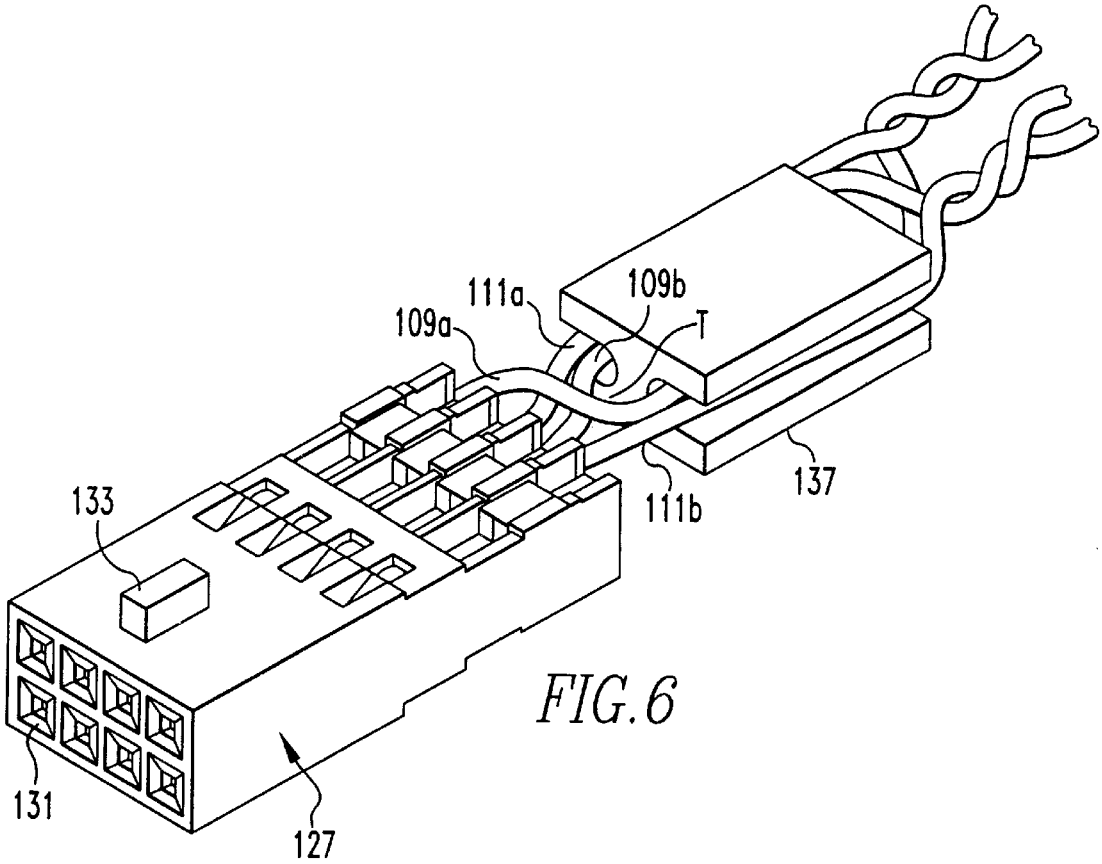
FIG. 6 is a perspective view of the insert after installation on the wires extending from the electrical connector shown of FIG. 4.
Figure 7:
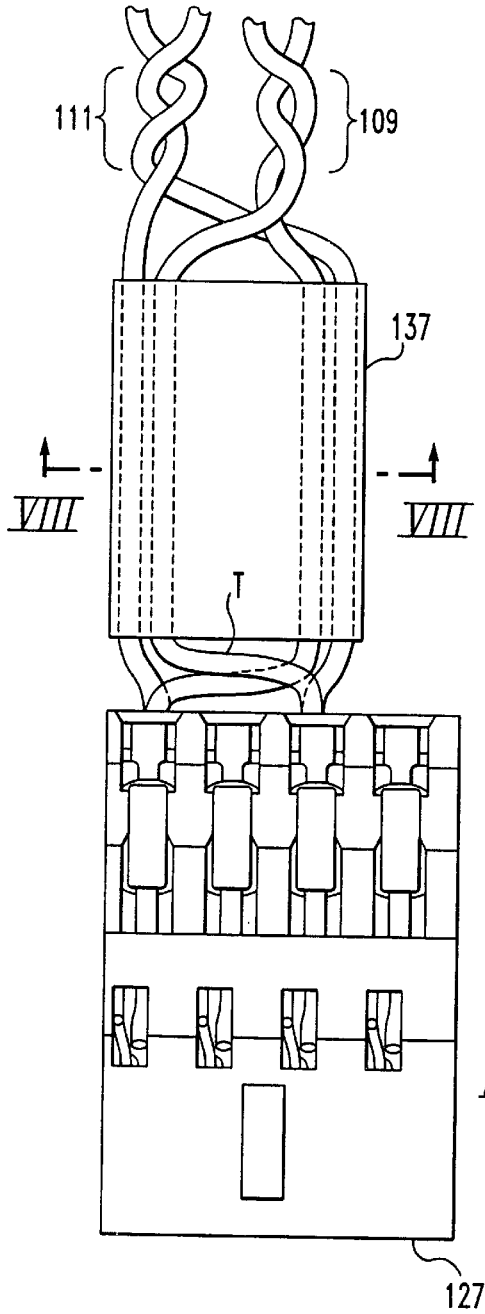
FIG. 7 is a top view of the insert after installation on the wires extending from the electrical connector of FIG. 4.
Figure 8:
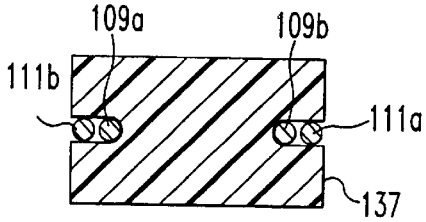
FIG. 8 is a cross-sectional view, taken along line VIII—VIII in FIG. 7, of the insert after installation on the wires.

Insert 137 also has a length L. Distance C and length L are chosen to provide the desired amount of compensating cross-talk. Increasing either length L or distance C increases the amount of compensating cross-talk. Insert 137 can also have any suitable height H to fit within the space provided by cover 129 and to provide adequate space for grooves 139. FIGS. 6–8 display insert 137 positioned between wires 109*a,* 109*b,* 111*a,* 111*b.* Preferably, each groove 139 of insert 137 receives one wire from each twisted pair 109, 111. Specifically, grooves 139 receive non-adjacent wires from each twisted pair 109, 111. As an example, FIG. 8 shows that wires 109*a,* 111*b* reside within one groove 139, while wires 109*b,* 111*a* reside in another groove 139. In order to ensure such an arrangement, one of the twisted pairs preferably retains a twist T between insert 137 and connector 127, while insert 137 resides between connector 127 and twists T on the other twisted pair as shown in FIG. 7.

Figure 9:
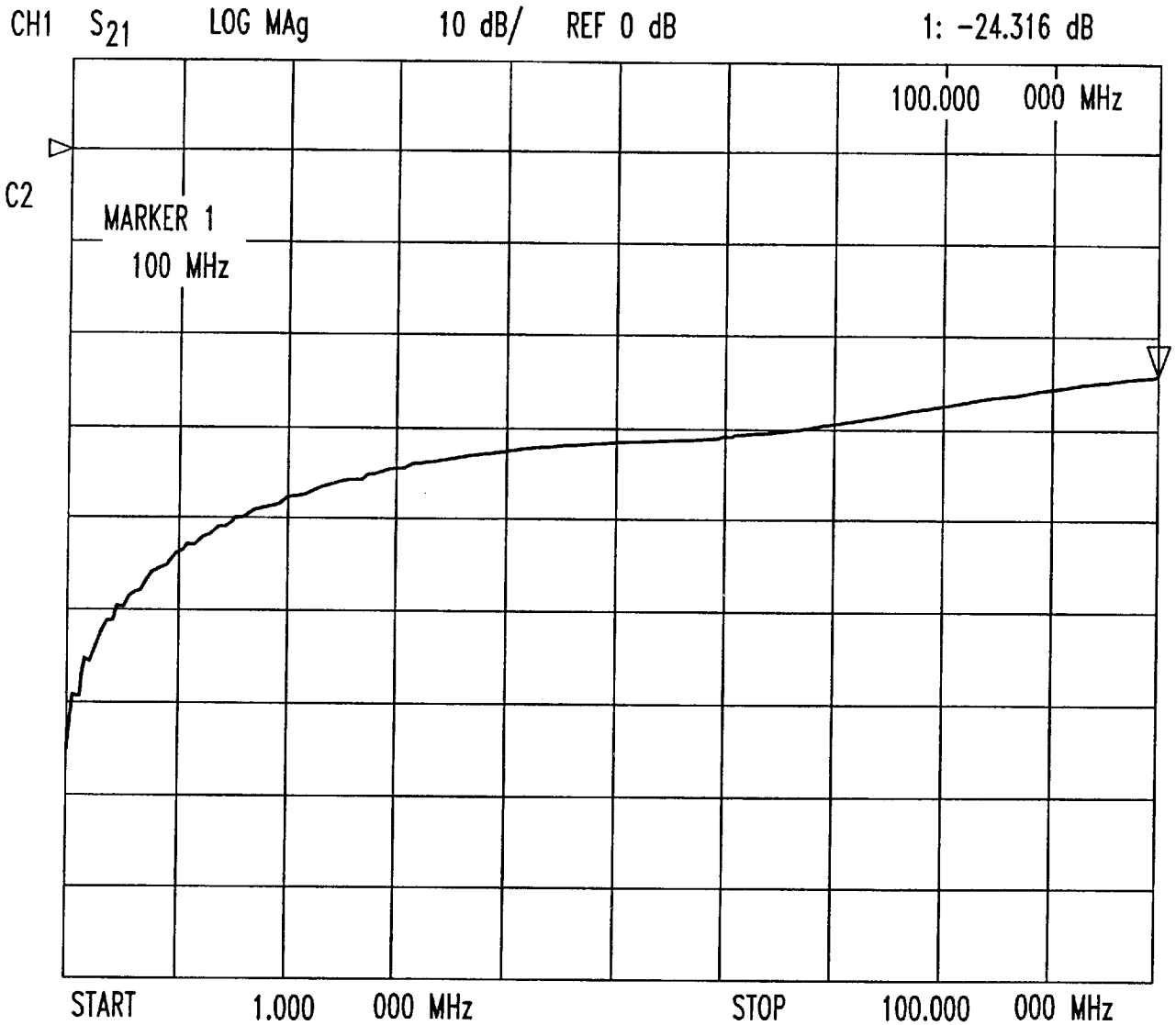
FIG. 9 displays a graph of the NEXT, measured from the end shown in FIG. 3, of an electrical cable assembly without the present invention.
Figure 10:
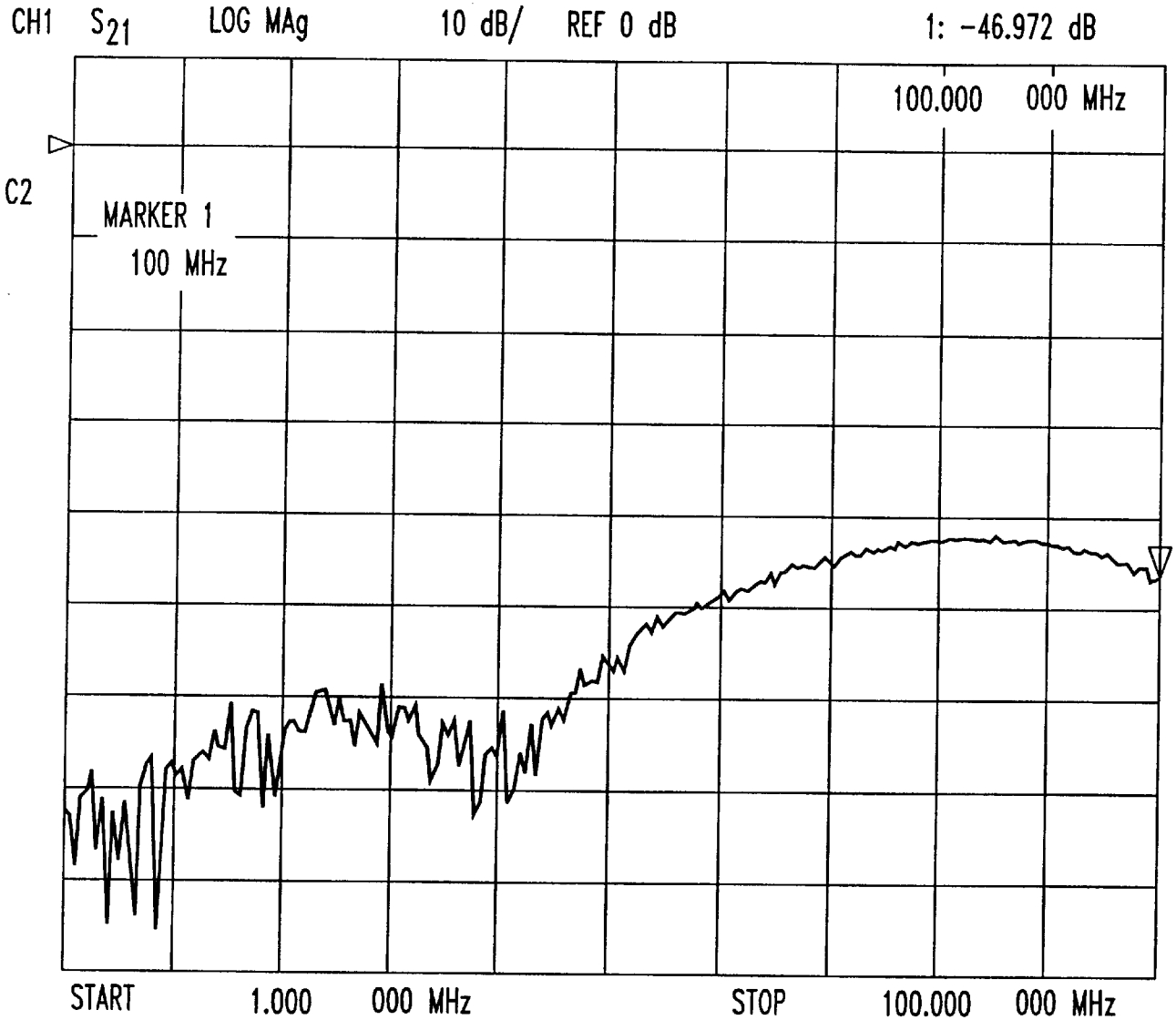
FIG. 10 displays a graph of the NEXT, similarly measured from the end shown in FIG. 3, of an electrical cable assembly with the present invention installed.

With this arrangement, the wires 109*a,* 109*b,* 111*a,* 111*b* create a compensating cross-talk that offsets most of the unwanted cross-talk created by connector 127 and its mating connector (not shown). FIGS. 9 and 10 display the benefits of using the present invention.

Figure 3:
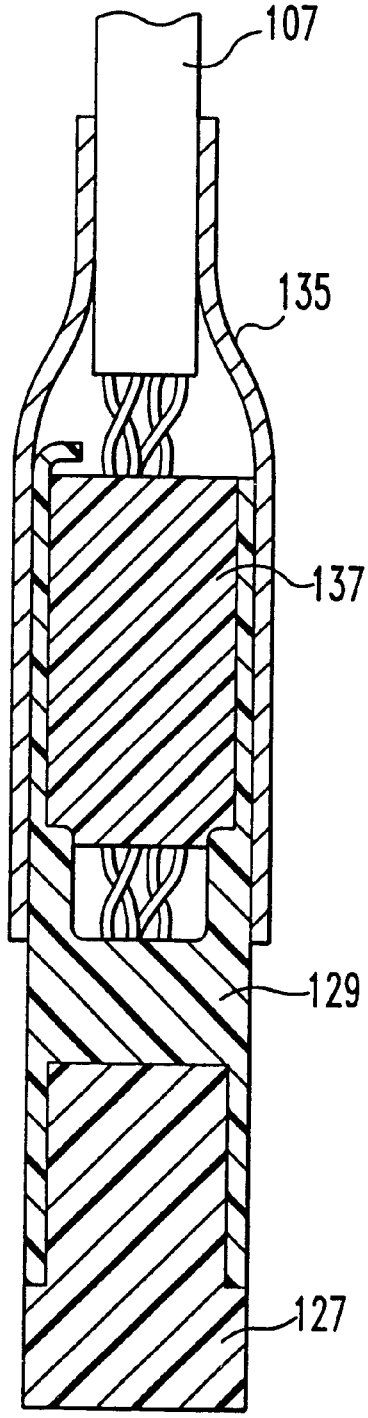
FIG. 3 is a cross-sectional view of the electrical connector shown in FIG. 2 taken along line III—III.

FIG. 9 demonstrates measured NEXT (measured at the end of the connector shown in FIG. 3) for a connector system that does not utilize insert 137. The graph shows the electrical cable assembly exhibits NEXT of less than approximately −24 dB across a frequency range of 1 to 100 MHz. In certain situations, this level of NEXT may be unacceptable.

FIG. 10 displays the results for the same electrical cable assembly (also measured at the end of the connector shown in FIG. 3), but using a simulated insert 137 having length L of 0.55" and a distance C of 0.25". The use of simulated insert 137 reduced NEXT to less than approximately −42 dB across a frequency range of 1 to 100 MHz. This level of NEXT is preferably acceptable during operation of cable assembly 100 within this frequency range.

Figure 11:
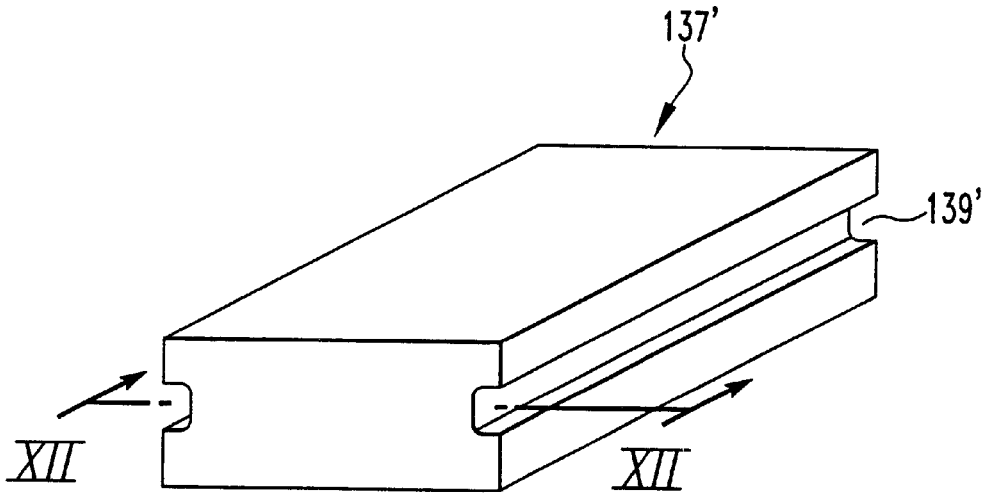
FIG. 11 is a perspective view of another alternative embodiment of the insert of the present invention.
Figure 12:
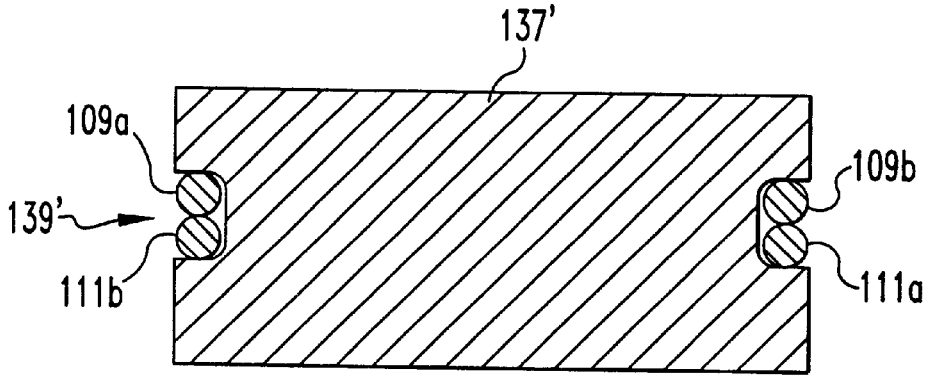
FIG. 12 is a cross-sectional view, taken along line XII—XII in FIG. 11, of the insert shown in FIG. 11 after installation on the wires extending from the electrical connector shown in FIG. 4.

FIGS. 11 and 12 demonstrate an alternative embodiment of the insert. Generally similar, the only difference between insert 137 and insert 137' resides in the shape of grooves 139/139'. Rather than a side-by-side arrangement with grooves 139 of insert 137, grooves 139' of insert 137' allow for the superposition of the wires. Although not shown, any other suitable arrangement could be used.

Figure 13:
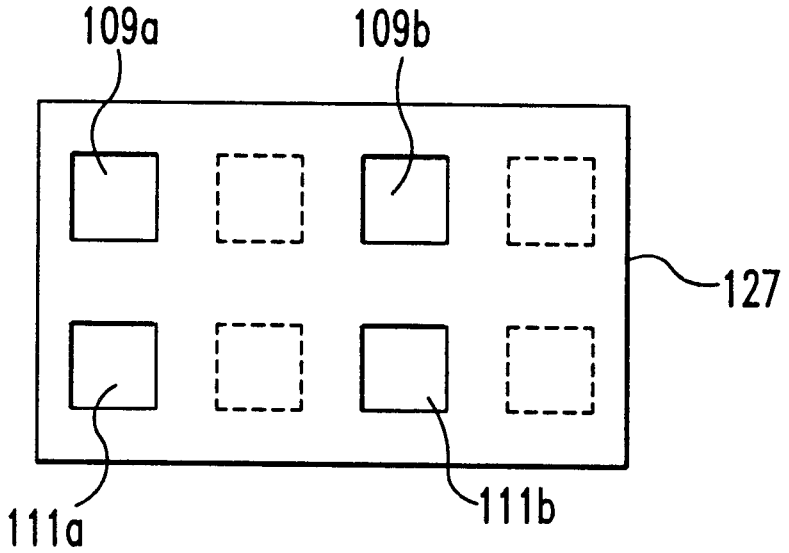
FIG. 13 is a schematic of the wire assignments for the sub-assembly shown in FIG. 3.

The present invention can be utilized in a pre-designed, and even a pre-assembled, electrical connector system. Since the connector system is pre-designed/pre-assembled, the wiring assignments are predetermined. Thus, no change in the wiring assignments could be made. For example, wires 109*a,* 109*b,* 111*a,* 111*b* must be placed in the specific locations shown in FIG. 13. The insert 137/137' is placed between wires 109*a,* 109*b,* 111*a,* 111*b* as shown in FIGS. 6–8.

Figure 14:
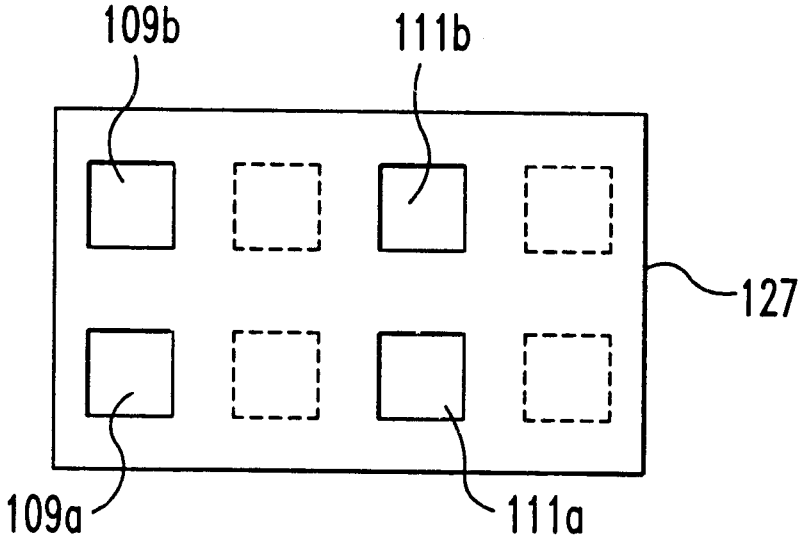
FIG. 14 is a schematic of another possibility for wire assignments for the sub-assembly shown in FIG. 3.
Figure 15:
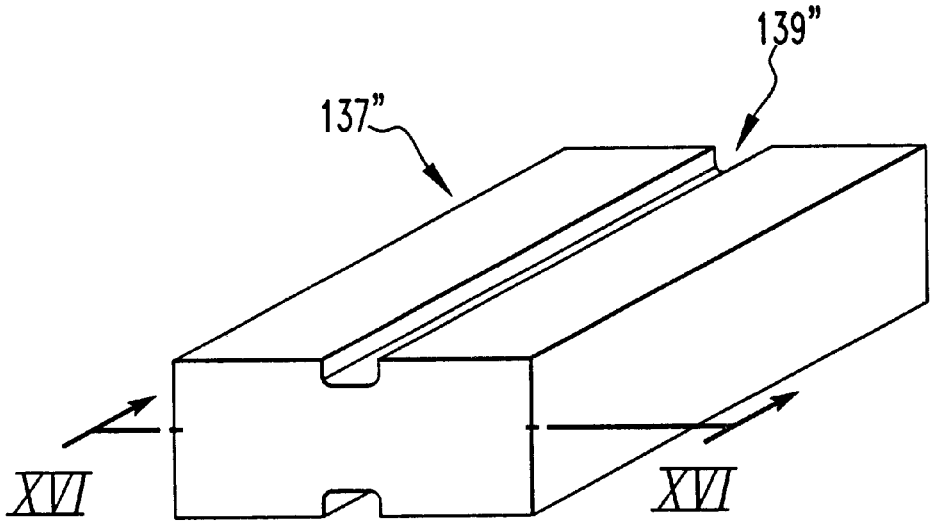
FIG. 15 is a perspective view of another alternative embodiment of the insert of the present invention.
Figure 16:
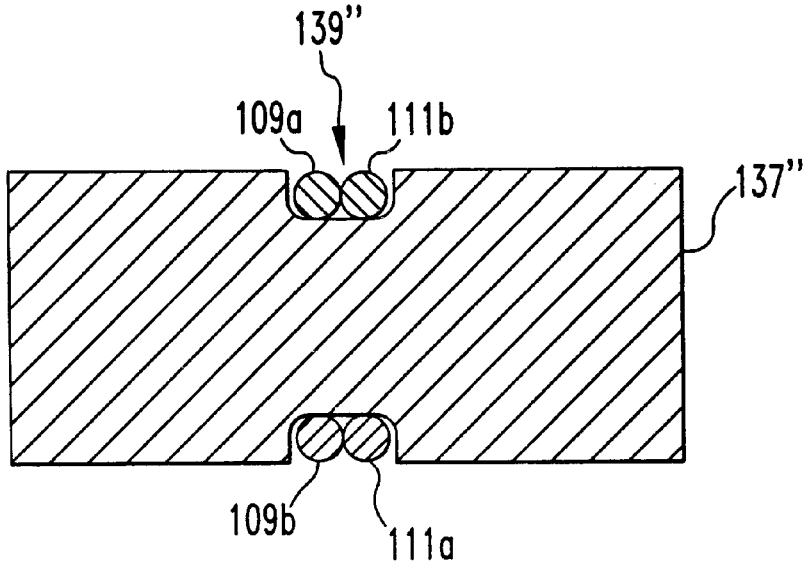
FIG. 16 is a cross-section view of the insert taken along line XVI—XVI in FIG. 15 after installation on the wires.

In situations other than the pre-assembled/pre-designed connector systems described above (i.e. in situations where the location of the wires could be changed), the present invention could achieve additional cross-talk reduction. For example, rearranging the location of wires 109*a,* 109*b,* 111*a,* 111*b* in connector 127 to the arrangement shown in FIG. 14 would reduce unwanted cross-talk even without using an insert. The use of an insert would reduce total cross-talk to a level lower than the cross-talk level that could be achieved in the arrangements shown in FIG. 6–8. FIGS. 15 and 16 display another alternative embodiment of insert 137" suitable for this situation. As with the other inserts 137/137', insert 137" is placed between wires 109*a,* 109*b,* 111*a,* 111*b.* The only difference between insert 137' and insert 137" resides in the location of grooves 139'/139". Rather than located on the side, grooves 139" of insert 137" are located on upper and lower surfaces of the block. Despite the different location of grooves 139" on insert 137" when compared to the other inserts 137/137', wires 109*a,* 111*b* still travel along one groove 139" and wires 109*b,* 111*a* travel along the other groove 139".

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector system, comprising:

an electrical connector, said electrical connector creating a first cross-talk;

first and second twisted pairs of wires extending from said connector; and a dielectric insert comprising first and second opposed surfaces;

wherein a first wire of said first twisted pair and a first wire of said second twisted pair correspond to a first surface of said insert and a second wire of said first twisted pair and second wire of said second twisted pair correspond to said second surface of said insert such that the wiring contributes towards creating a compensating cross-talk to said first cross-talk.

2. The electrical connector system according to claim 1, wherein said insert has a predetermined length, said predetermined length contributes towards creating said compensating cross-talk.

3. The electrical connector system according to claim 2, wherein said insert separates said wires to a predetermined spacing, said predetermined spacing further contributing towards creating said compensating cross-talk.

4. The electrical connector system according to claim 3, wherein said compensating cross-talk is substantially equal to said first cross-talk.

5. A method of substantially reducing the cross-talk in a connector, comprising the steps of:

providing an pre-constructed electrical connector system having an electrical connector with at least first and second twisted pairs of wires, each wire of said twisted pairs of wires terminated to a contact and extending from the connector;

providing an insert having first and second opposed surfaces:

placing a first wire of said first twisted pair and a first wire of said second twisted pair adjacent said first surface of said insert and a second wire of said first twisted pair and second wire of said second twisted pair adjacent said second surface of said insert.

* * * * *

UNITED STATES PATENT AND TRADEMARK OFFICE

CERTIFICATE OF CORRECTION

PATENT NO. : 6,520,807 B2 
DATED : February 18, 2003
INVENTOR(S) : Clifford L. Winings It is certified that error appears in the above-identified patent and that said Letters Patent is hereby corrected as shown below:

Title page,
Item [56], References Cited, FOREIGN PATENT DOCUMENTS, should read:

| | | |
|---|---|---|
| -- PCT | WO 99/53574 | 10/99 |
| PCT | WO 00/49683 | 8/00 |
| EPO | EP 0 901 201 A1 | 3/99 |
| DE | 196 49 668 C 1 | 5/98 -- |

Column 5,
Line 4, after the number "139.", a new paragraph should begin.

Signed and Sealed this

Fourth Day of May, 2004

JON W. DUDAS
*Acting Director of the United States Patent and Trademark Office*